US005328401A

United States Patent [19]

DeMars

[11] Patent Number: 5,328,401

[45] Date of Patent: Jul. 12, 1994

[54] BLUSHING TOY

[76] Inventor: Robert A. DeMars, 23 221 Ladrillo Ave., Woodland Hills, Calif. 91367

[21] Appl. No.: 856,359

[22] Filed: Mar. 23, 1992

[51] Int. Cl.[5] ..... A63H 3/00

[52] U.S. Cl. ..... 446/295; 446/372; 446/485

[58] Field of Search ..... 446/295, 485, 369, 372; 362/295; 307/141

[56] References Cited

U.S. PATENT DOCUMENTS

| | | | |
|---|---|---|---|
| 4,038,561 | 7/1977 | Lorenz | 307/141 |
| 4,585,424 | 4/1986 | Demars | 446/295 |
| 4,924,109 | 5/1990 | Weber | 307/141 X |
| 5,114,376 | 5/1992 | Copley et al. | 446/485 X |

*Primary Examiner*—Mickey Yu
*Attorney, Agent, or Firm*—Jack C. Munro

[57] ABSTRACT

In combination with a childrens cuddly toy, a facial plate which will move when contacted manually by a child. This movement will cause a light to shine through the actuating plate and then slowly dim giving the appearance of blushing.

2 Claims, 2 Drawing Sheets

BLUSHING TOY

BACKGROUND OF THE INVENTION

1) Field of this Invention

The field of this invention relates to childrens toys and more particularly to a hand holdable doll type of toy which is actuatable by the child to cause the toy to give the appearance of blushing.

2) Description of the Prior Art

Blushing is known as a reddening of the cheeks within a human. Blushing is usually associated with individuals that are shy and sensitive. Blushing is an occurrence that is deemed by many to be cute.

In constructing of doll like toys for children, it is known to impart certain life-like functions to these toys. An example of such a life-like functions would be to have the toy talk. Other life-like functions are is to have the toy cry and to even wet a diaper. Each of these functions is initiated by the child.

One human function which prior to the present invention has not been incorporated within a doll or doll like toy is blushing. Blushing is an attractive function and it would be desireable to somehow incorporate this function in conjunction with a child's toy.

SUMMARY OF THE INVENTION

The structure of the present invention relates to an appearance-altering apparatus incorporated in conjunction with a cuddly toy which can be generically defined as a doll. This cuddly toy is to have a face and the face is to have cheeks. These cheeks are defined by a plate with this plate being pressable inwardly a short distance by the child. Interiorly of this plate there is located a pair of lightbulbs with a single lightbulb being associated with each cheek. Pressing inwardly on the plate and releasing such will cause the two lightbulbs to be activated simultaneously. This plate is not transparent but is translucent so that the activation of the lightbulbs will be observable through the plate. The light bulbs after activation will slowly diminish in illumination, over a period of a few seconds, with the bulbs then being deactivated. The resulting appearance exteriorly of the mounting plate is that of the human function of blushing.

The primary objective of the present invention is to incorporate a lighting apparatus in conjunction with a hand holdable doll type of toy which will give the appearance of blushing when activated.

Another objective of the present invention is to construct a blushing apparatus which can be manufactured relatively inexpensively therefore permitting the doll within which the apparatus is incorporated to be sold at a relatively inexpensive price to the consumer.

Another objective of the present invention is to construct a blushing type of apparatus which is of simple construction so as to minimize the possibility of breakdown of the blushing apparatus even after an extended period of usage.

DETAILED DESCRIPTION OF THE SHOWN EMBODIMENT

Figure 1:
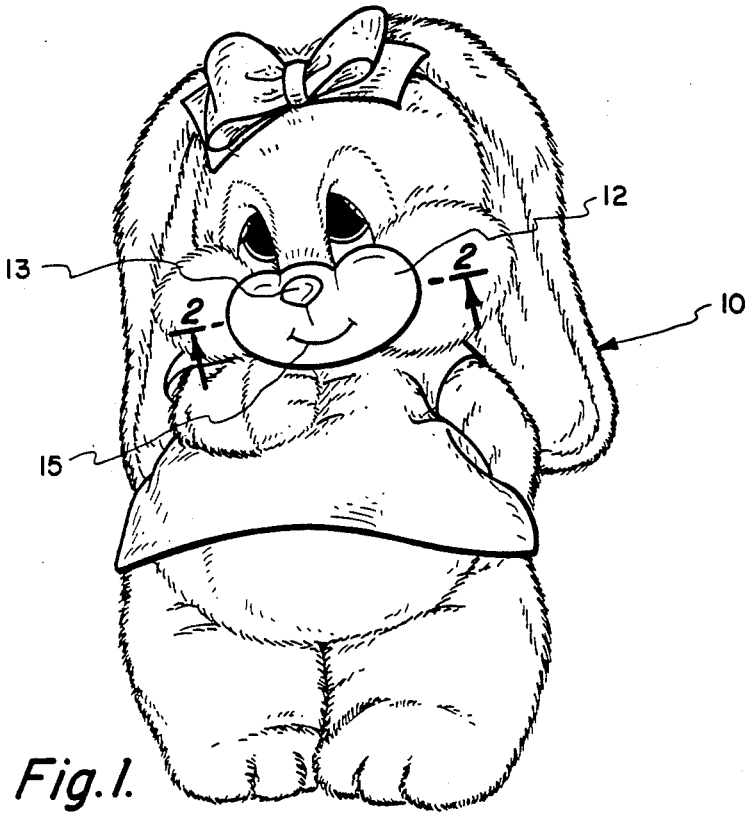
FIG. 1 is a front view of a cuddly type of toy within which the apparatus of the present invention has been incorporated.

Referring particularly to the drawings there is shown a hand holdable toy 10 in the configuration of a cuddly bear or rabbit. The toy 10 has a portion of the face covered by an actuating plate 12. Plate 12 includes a centrally located protuberance 13 which is to represent a nose and a curved recess 15 used to represent a mouth. The actuating plate 12 has an internal chamber 17. The actuating plate 12 has a side edge 19 which is mounted onto a mounting plate 14. In between the side edge. 19 and the mounting plate 14 is a seal 16.

The mounting plate 14 is located in a spaced relationship from a fixed plate 34. Connecting the mounting plate 14 to the fixed plate 34 is by means of bolt-type fasteners 22 and 24 which connect respectively to nuts 26 and 28. Associated with bolt fastener 22 is a washer 30 with a similar washer 32 being located against the enlarged head of the bolt fastener 24. The washers 30 and 32 abut against the fixed plate 34. The bolt fastener 22 extends through a tubular spacing sleeve 18 with the bolt fastener 24 extending through a tubular spacing sleeve 20. The sleeves 18 and 20 are of the same length and function to retain in position the respective washers 30 and 32 and maintain such in contact with the enlarged head of the respective bolt fasteners 22 and 24. One end of each of the sleeves 18 and 20 abuts against the inner surface of the mounting plate 14.

Figure 2:
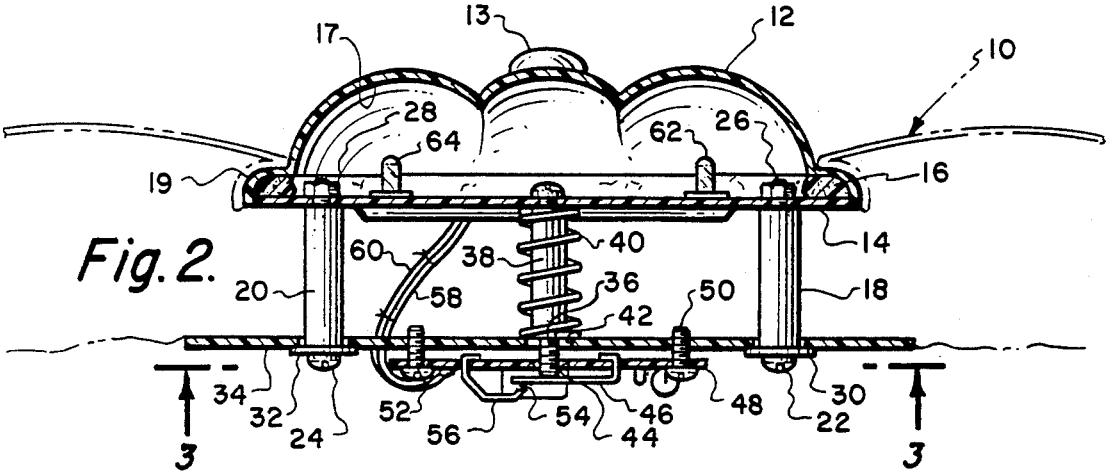
FIG. 2 is a cross-sectional view through the face section of the cuddly toy taken along line 2—2 of FIG. 1 showing the blushing apparatus in a deactivated position.
Figure 3:
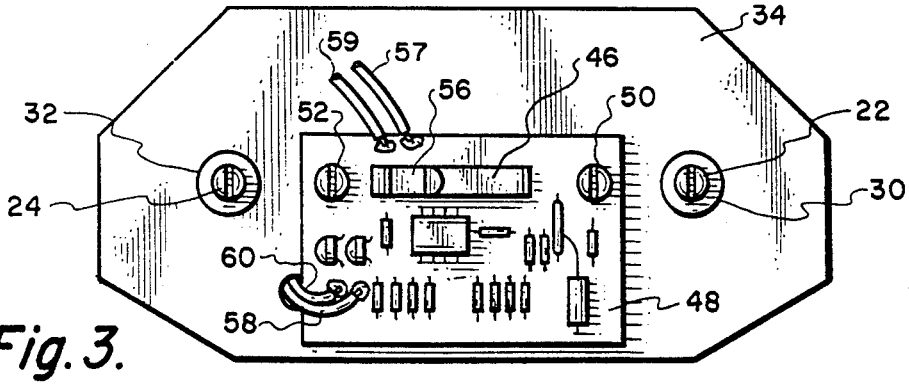
FIG. 3 is a bottom view of the blushing apparatus of the present invention taken along line 3—3 of FIG. 2.

Threadably secured and centrally located within the mounting plate 14 is a threaded fastener 36. The threaded fastener 36 is of sufficient length to extend through hole 42 of fixed plate 34 and also hole 44 of circuit board 48. Mounted around the bolt fastener 36 is a tubular sleeve 38. One end of the sleeve 38 abuts against the inner surface of the mounting plate 14 and the opposite end of the sleeve 36 is located within the hole 42. Mounted around the sleeve 38 is a coil spring 40. One end of the coil spring 40 abuts against the inner surface of the mounting plate 14 and also abuts against the outer surface of the fixed plate 34. The function of the coil spring 40 is to exert a continuous bias between the plates 14 and 34 tending to locate these plates in the furthest spaced position which is shown in FIG. 2. In this particular position, both washers 30 and 32 are in contact with the fixed plate 34.

The free outer end of the threaded fastener 36 rests against movable switch bar 46. The movable switch bar 46 is mounted on the circuit board 48. The circuit board 48 is fixedly mounted by threaded fasteners 50 and 52 to the fixed plate 34.

Figure 4:
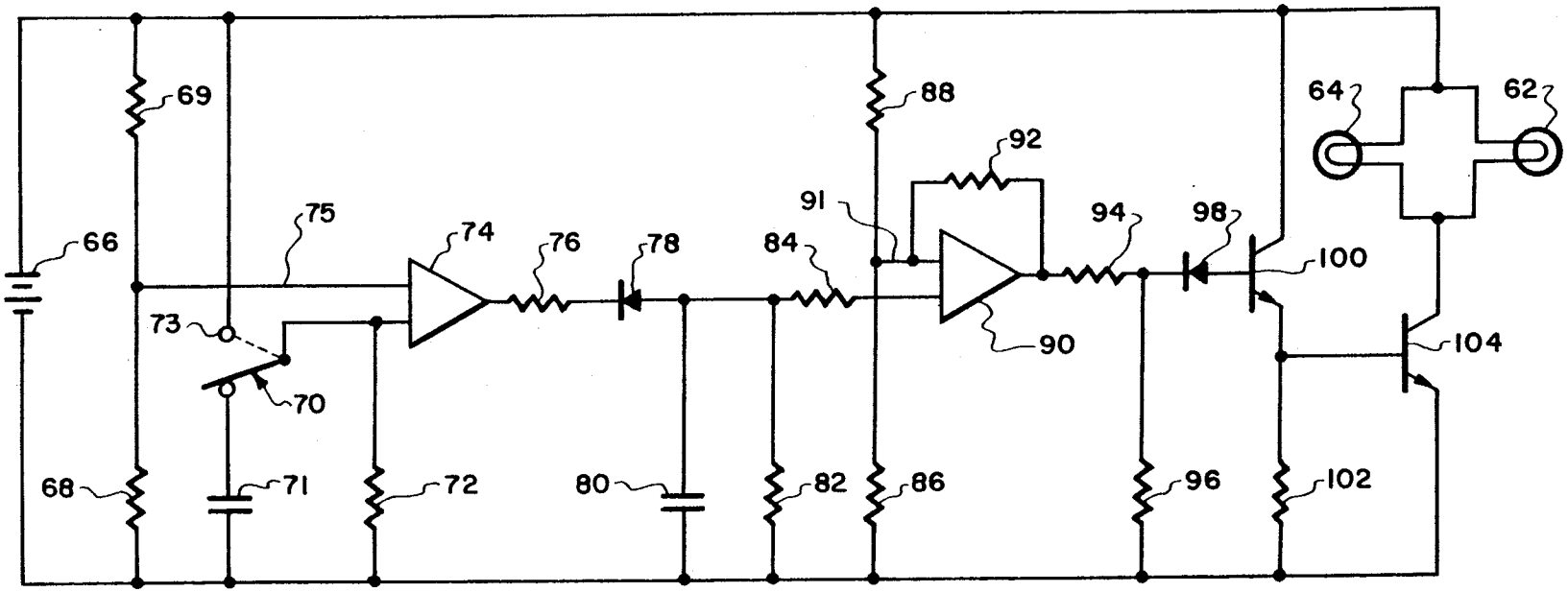
FIG. 4 is an electrical schematic for the electrical circuitry incorporated in conjunction with the blushing apparatus of the present invention.
Figure 5:
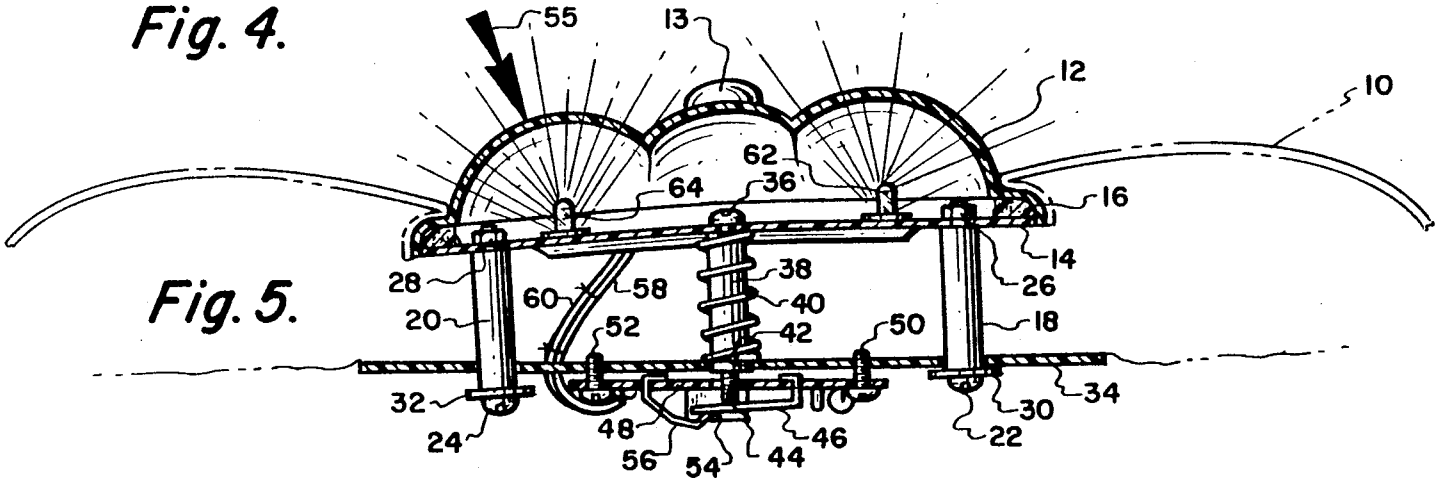
FIG. 5 is a cross-sectional view similar to FIG. 2 but showing the apparatus in the activated position.

Located in close proximity to movable switch bar 46, but slightly spaced therefrom, forming air gap 54 is fixed switch bar 56. Fixed switch bar 56 is fixedly mounted on the circuit board 48. If a slight manual pressure is applied to the actuating plate 12, as represented by arrow 55, one of the washers 30 or 32 (or possibly both) will be moved away from the fixed plate 34. This position is shown in FIG. 5 of the drawings. If this movement is sufficient, the movable switch bar 46 will come into contact with fixed switch bar 56 which will cause switch 70 to move from the solid line position shown in FIG. 4 to the dotted line position. This will cause electrical energy from battery 66, which is supplying energy through wires 57 and 59 to the circuit board 48, to be conducted through wires 58 and 60 and cause activation of lightbulbs 62 and 64.

Lightbulbs 62 and 64 are fixedly mounted on the mounting plate 14. Both bulbs 62 and 64 are located within the internal chamber 17. Bulb 62 is located directly adjacent the right cheek area of the actuating plate 12 with bulb 64 being located directly adjacent the left cheek area of the actuating plate 12. It is to be understood that the actuating plate 12 will be constructed of a translucent plastic generally of a flesh color. When the bulbs 62 and 64 are illuminated, there is an exterior appearance resembling blushing created by the illumination of the bulbs 62 and 64.

As previously mentioned, when the actuating plate 12 is pressed, switch 70 momentarily connects with contact 73 which causes current to flow to charging capacitor 71. When the actuating plate 12 is released, switch 70 returns to a solid line position shown in FIG. 4 and capacitor 71 is connected to the non-inverting input of amplifier 74. Resistor 72 also connects to the non-inverting input of amplifier 74. Resistor 72 connects the non-inverting input of amplifier 74 to one side of the battery 66. An output from amplifier 74 now occurs which is conducted through resistor 76 and diode 78. When the voltage rises above a certain value (generally about three quarters of a volt), diode 78 becomes a conductive charging capacitor 80. As capacitor 71 discharges through resistor 72, the voltage decreases until it falls below that applied to the inverting input 75 of the amplifier 74. The amount of voltage applies to the inverting input 75 is determined by a voltage divider consisting of resistors 68 and 69. At this particular time, the output from the amplifier 74 ends. The amount of time the amplifier 74 generates an output is determined by the values of capacitor 71 and resistor 72.

When the output occurs at amplifier 74, a rising voltage appears at the non-inverting input of amplifier 90. The time that this voltage is applied to the amplifier 90 is determined in part by the values of resistors 82 and 84. The applied voltage to the inverting input of amplifier 90 is determined by voltage divider consisting of resistors 86 and 88.

As capacitor 80 charges, the voltage applied to the non-inverting input of amplifier 90 rises until it exceeds that set by the voltage divider consisting of resistors 86 and 88 and an output appears within resistor 94 and diode 98. The length of time that the output of amplifier 90 is applied to resistor 94 and diode 98 is determined by the size of resistor 92. The output within resistor 94 and diode 98 tracks the voltage applied to the non-inverting input of amplifier 90 and, in effect, reflects the charge state of capacitor 80 reaching a peak when the timing cycle, set by capacitor 71 and resistor 72, ends.

When the output from amplifier 90 ends, the voltage applied to capacitor 80 ceases and capacitor 80 begins a discharge through the resistor network composed of resistors 82 and 84. As the voltage applied to the non-inverting input of amplifier 90 decreases, the output of amplifier 90 decreases until the voltage falls below that applied to the inverting input 91 at which time the output ends of amplifier 90. The output curve of amplifier 90 is thus determined by the charge and discharge rate of capacitor 80.

When an output occurs at amplifier 90, the resulting output is then applied through transistors 100 and 104. The transistors 100 and 104 form a driver circuit powering the lightbulbs 62 and 64. A resistor 96 connects the output of the amplifier 90 to one side of battery 66. Also, the output of transistor 100 is connected by resistor 102 to one side of the battery 66 as well as the output of one side of the transistor 104.

The actuating plate 12 is caused to initially glow dimly by the lightbulbs 62 and 64 and then to become bright within about four seconds. The actuating plate 12 remains bright for a period of about four seconds and then proceeds to slowly dim in about four seconds until the lightbulbs 62 and 64 are deactivated. This procedure essentially simulates a blushing response.

What is claimed is:

1. In combination with a hand-holdable childrens toy, said toy having an exterior surface, an appearance altering apparatus giving the appearance of blushing, said appearance altering apparatus comprising:

an electrical light circuit mounted in said toy, said circuit including light means and a battery, said battery to cause activation of said light means, said circuit to cause said light means to slowly dim after said activation;

an actuating plate mounted on said exterior surface, said actuating plate to be contacted manually by the child, said actuating plate being connected to said circuit, upon said actuating plate being manually contacted and then released, said light means being activated;

said actuating plate being moveable on said exterior surface, movement of said actuating plate causes said light means to be activated; and said actuating plate being translucent, said light means being located interiorly of said actuating plate, whereby activation of said light means shines through said translucent actuating plate.

2. The combination as defined in claim 1 wherein:

said actuating plate being configured to resemble facial cheeks.

* * * * *